US010960565B2

(12) United States Patent
Zach

(10) Patent No.: US 10,960,565 B2
(45) Date of Patent: Mar. 30, 2021

(54) CUTTER MECHANISM FOR A PRINTER AND METHODS OF CUTTING PAPER MEDIA IN A PRINTER

(71) Applicant: TransAct Technologies Incorporated, Hamden, CT (US)

(72) Inventor: Peter Zach, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 0 days.

(21) Appl. No.: 16/294,046

(22) Filed: Mar. 6, 2019

(65) Prior Publication Data

US 2020/0282583 A1 Sep. 10, 2020

(51) Int. Cl.

| | |
|---|---|
| ***B26D 1/22*** | (2006.01) |
| ***B26D 1/00*** | (2006.01) |
| ***B26D 7/26*** | (2006.01) |
| ***B41J 11/70*** | (2006.01) |
| *B26D 7/00* | (2006.01) |

(52) U.S. Cl.

CPC ..... *B26D 1/225* (2013.01); *B26D 1/0006* (2013.01); *B26D 7/2614* (2013.01); *B41J 11/706* (2013.01); *B26D 2001/0066* (2013.01); *B26D 2007/005* (2013.01)

(58) Field of Classification Search

CPC .... B26D 1/225; B26D 1/0006; B26D 7/2614; B26D 2007/005; B26D 2001/0066; B41J 11/706

See application file for complete search history.

(56) References Cited

U.S. PATENT DOCUMENTS

| | | | |
|---|---|---|---|
| 1,447,247 | A | 3/1923 | Hilsdorf |
| 2,170,147 | A | 8/1939 | Lane |

(Continued)

FOREIGN PATENT DOCUMENTS

| | | |
|---|---|---|
| JP | 60161851 | 8/1985 |
| JP | 05278906 | 10/1993 |

OTHER PUBLICATIONS

Pitney Bowes Inc.; Accelerated processing, Digital Mailing System with ItelliLink Technology DM400 Series; brochure; 4 pages; 2008.

(Continued)

*Primary Examiner* — Stephen Choi

(74) *Attorney, Agent, or Firm* — Lipsitz & McAllister, LLC

(57) ABSTRACT

A cutter mechanism for a printer is provided. The cutter mechanism comprises a rotary cutter and a straight blade assembly. The rotary cutter may be mounted for rotation about a rotation axis and for translation across at least a portion of a width of a paper path perpendicular to the rotation axis. The straight blade assembly may be mounted for rotation about a shaft and adapted to cooperate with the rotary cutter. The straight blade assembly comprises a straight blade extending across the width of the paper path. A printer mechanism cover is mounted coaxially on the shaft so as to be movable between a closed position and an open position. A portion of the cover may impact the straight blade assembly when the cover is moved from the closed position to the open position, causing the straight blade to be moved away from the rotary cutter.

14 Claims, 11 Drawing Sheets

(56) References Cited

U.S. PATENT DOCUMENTS

| | | | | |
|---|---|---|---|---|
| 3,447,409 | A | 6/1969 | Lewis | |
| 3,791,248 | A | 2/1974 | Pearson | |
| 4,065,990 | A | 1/1978 | Edhlund | |
| 4,448,101 | A | 5/1984 | Templeton | |
| 4,979,838 | A | 12/1990 | Yokota et al. | |
| 4,981,059 | A | 1/1991 | Kobayashi | |
| 5,174,824 | A | 12/1992 | Salancy et al. | |
| 5,215,393 | A | 6/1993 | Wincent | |
| 5,243,890 | A | 9/1993 | Ober | |
| 5,531,530 | A | 7/1996 | Kuramoto et al. | |
| 5,690,437 | A | 11/1997 | Yanagisawa et al. | |
| 5,749,277 | A | 5/1998 | Walker | |
| 6,155,731 | A | 12/2000 | Bertalan et al. | |
| 6,508,600 | B1 | 1/2003 | Nonaka | |
| 6,609,844 | B1 | 8/2003 | Petteruti et al. | |
| 6,793,423 | B1 * | 9/2004 | Saito | B41J 11/70 101/93.07 |
| 7,392,731 | B2 | 7/2008 | Nonaka | |
| 7,404,683 | B2 | 7/2008 | Mochizuki et al. | |
| 7,588,811 | B2 | 9/2009 | Blank et al. | |
| 7,604,426 | B2 | 10/2009 | Hanaoka et al. | |
| 7,857,534 | B2 | 12/2010 | Watanabe et al. | |
| 8,297,864 | B2 | 10/2012 | Tsugaru et al. | |
| 8,439,584 | B2 | 5/2013 | Hanaoka et al. | |
| 8,747,000 | B2 | 6/2014 | Hanaoka et al. | |
| 8,960,064 | B2 | 2/2015 | Supron et al. | |
| 9,452,543 | B2 | 9/2016 | Supron et al. | |
| 2003/0198499 | A1 | 10/2003 | Tsuchiya et al. | |
| 2004/0184863 | A1 | 9/2004 | Mori et al. | |
| 2005/0232678 | A1 | 10/2005 | Mochizuki et al. | |
| 2007/0104527 | A1 | 5/2007 | Watanabe et al. | |
| 2007/0110493 | A1 | 5/2007 | Chen | |
| 2007/0231043 | A1 | 10/2007 | Miyashita et al. | |
| 2007/0262141 | A1 | 11/2007 | Ito et al. | |
| 2009/0219375 | A1 * | 9/2009 | Trauer | B41J 11/70 347/197 |
| 2010/0043617 | A1 | 2/2010 | Sato | |
| 2010/0139467 | A1 | 6/2010 | Gutknecht et al. | |
| 2014/0056633 | A1 * | 2/2014 | Tsuchiya | B26D 1/045 400/621 |

OTHER PUBLICATIONS

Star Micronics America, Inc.; TSP High-speed, graphics, reports & receipt printer; 2 pages; 2008.

Swecoin US Inc.; Kiosk Printer TTTP 2000—series; 2 pages; 2006.

* cited by examiner

DETAIL B

DETAIL C

DETAIL D

SECTION B-B

CUTTER MECHANISM FOR A PRINTER AND METHODS OF CUTTING PAPER MEDIA IN A PRINTER

BACKGROUND OF THE INVENTION

The present invention relates to the field of cutter mechanisms for printers. More specifically, the present invention relates to a cutter mechanism for cutting paper media in a printer and methods of cutting paper media in a printer using such a cutter mechanism.

High speed printers, such as inkjet, thermal, dye sublimation and dot matrix printers are used to provide vouchers, coupons, tickets, receipts and the like (all generally referred to herein as "tickets") to consumers. Such printers typically use a roll of paper media which is cut by a cutter. Different types of cutters may be used in such printers, including a rotary cutter or a guillotine knife blade type cutter. The guillotine knife cutters typically employ a fixed blade and a movable blade which is displaced in the direction of, and engages against, the fixed blade during a cutting action after the ticket is printed on the paper media. While such guillotine knife blades are generally simpler and less expensive than rotary knife blades, such guillotine knife blades are prone to jamming and difficult to service. It is also typically difficult to load paper into printers having guillotine knife blades.

It would be advantageous to improve the prior art guillotine knife blade type cutters to provide improved serviceability and reliability, and to enable easy loading of paper and clearance of paper jams. It would be advantageous to enable easy separation of the knife blades for service and jam clearance. It would also be advantageous to provide a cutter mechanism that has a reduced complexity and size as compared to the prior art cutter mechanisms.

The apparatus and methods of the present invention provide the foregoing and other advantages.

SUMMARY OF THE INVENTION

The present invention relates to a cutter mechanism for a printer and methods of cutting paper media in a printer using such a cutter mechanism.

In one example embodiment of the invention, a cutter mechanism for a printer is provided. The cutter mechanism comprises a rotary cutter and a straight blade assembly. The rotary cutter may be mounted for rotation about a rotation axis and for translation across at least a portion of a width of a paper path perpendicular to the rotation axis. The straight blade assembly may be mounted for rotation about a shaft and adapted to cooperate with the rotary cutter. The straight blade assembly comprises a straight blade extending across the width of the paper path. A printer mechanism cover is mounted coaxially on the shaft so as to be movable between a closed position and an open position. A portion of the cover may impact the straight blade assembly when the cover is moved from the closed position to the open position, causing the straight blade to be moved away from the rotary cutter.

The straight blade assembly may further comprise a mount for securing the straight blade to the shaft for rotation.

The straight blade may contact the rotary cutter in the closed position of the cover.

The straight blade assembly may be moved away from the cover in the closed position of the cover.

The cutter mechanism may further comprise a biasing mechanism for biasing the straight blade against the rotary cutter in the closed position of the cover. The biasing mechanism may comprise at least one spring extending between the cover and the straight blade assembly.

The cutter mechanism may further comprise a carriage for carrying the rotary cutter, and a gear, rack, and lead screw assembly for rotating and translating the rotary cutter. The rotary cutter may be rotatably mounted on the carriage. The gear may be mounted to the rotary cutter. The carriage may be mounted on the lead screw and adapted to translate along the lead screw upon rotation of the lead screw. As the carriage translates along the lead screw, teeth of the gear contact corresponding teeth of the rack, causing the rotary cutter to rotate as the carriage translates.

The present invention also includes methods corresponding to the above-described apparatus. An example embodiment of a method for cutting paper media in a printer in accordance with the present invention may comprise: providing a rotary cutter mounted for rotation about a rotation axis and for translation across at least a portion of a width of a paper path perpendicular to the rotation axis; mounting a straight blade assembly for rotation about a shaft and for cooperation with the rotary cutter, the straight blade assembly comprising a straight blade extending across the width of the paper path; and mounting a printer mechanism cover coaxially on the shaft so as to be movable between a closed position and an open position. In a closed position of the cover in which the rotary cutter is in engagement with the straight blade, the rotary cutter is translated across at least a portion of the width of the paper path for cutting the paper media during a cutting action. A portion of the cover may impact the straight blade assembly when the cover is moved from the closed position to the open position, causing the straight blade to be moved away from the rotary cutter.

The method embodiments of the present invention may also include various features of the apparatus embodiments discussed above.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to a cutter mechanism for a printer and corresponding methods for cutting paper media in a printer using such a cutter mechanism.

Figure 1:
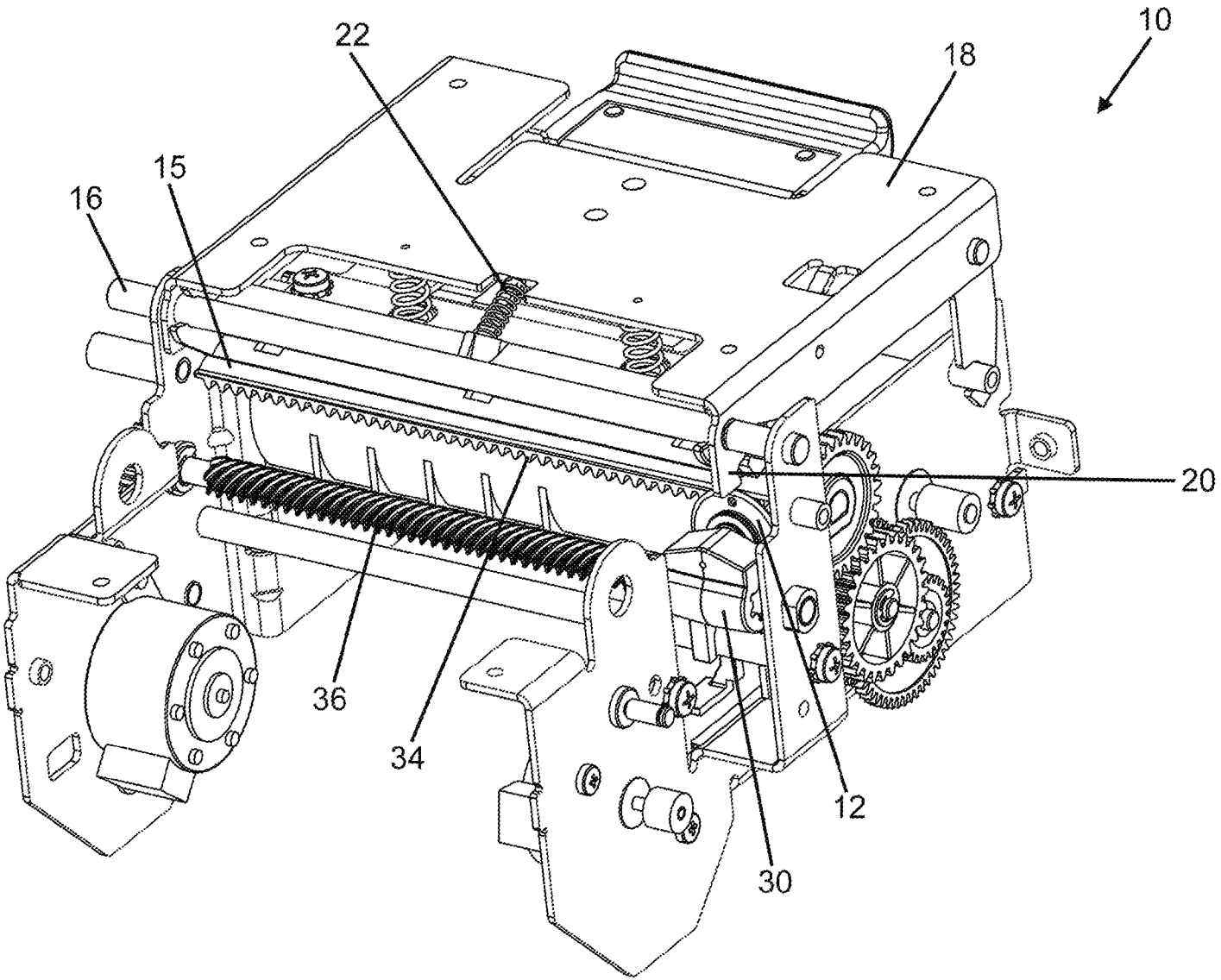
FIG. 1 shows a perspective view of an example embodiment of a printer mechanism with the cover closed in accordance with the present invention.
Figure 2A:
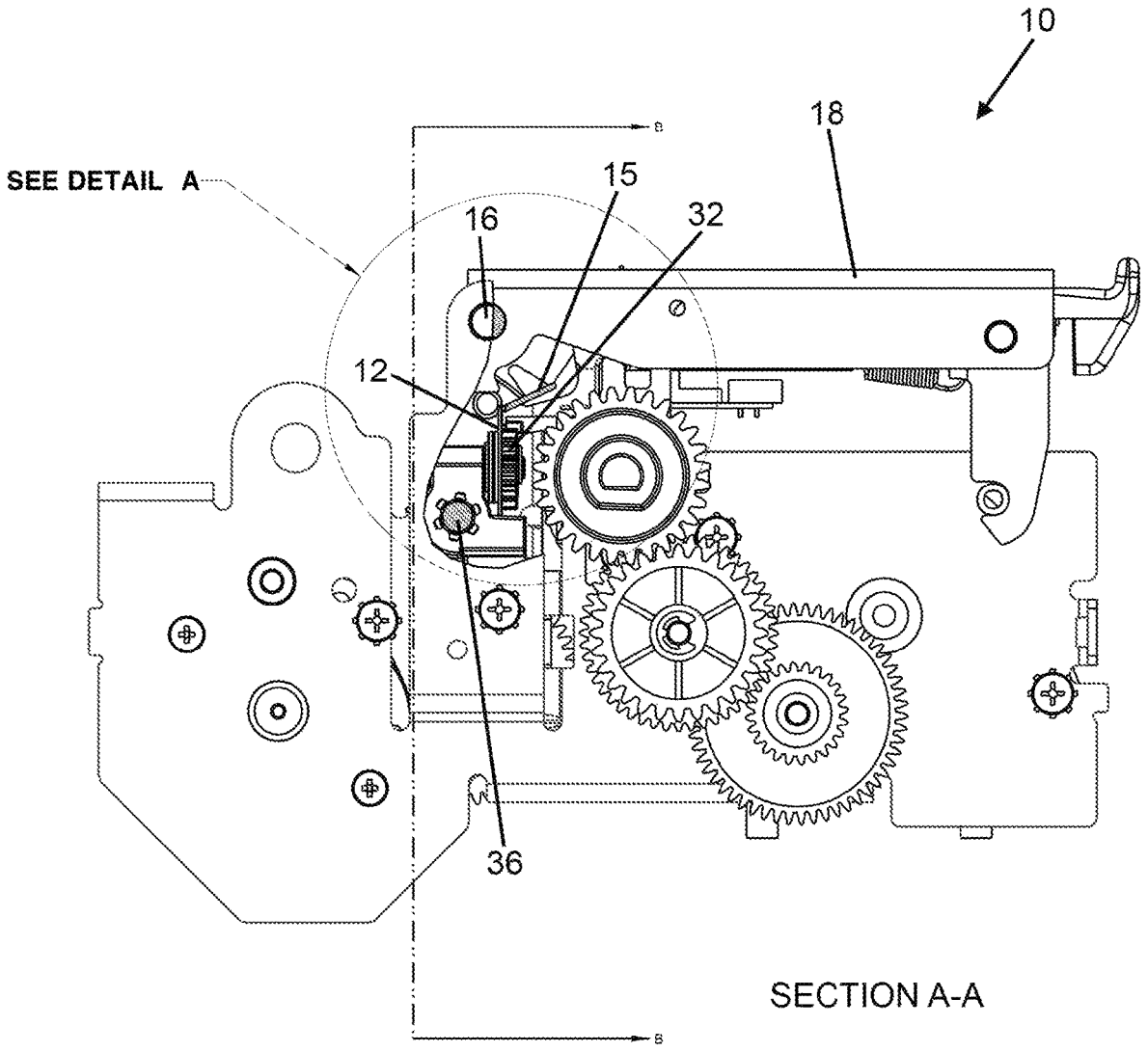
FIG. 2A shows a section view of an example embodiment of a printer mechanism with the cover closed in accordance with the present invention.
Figure 2B:
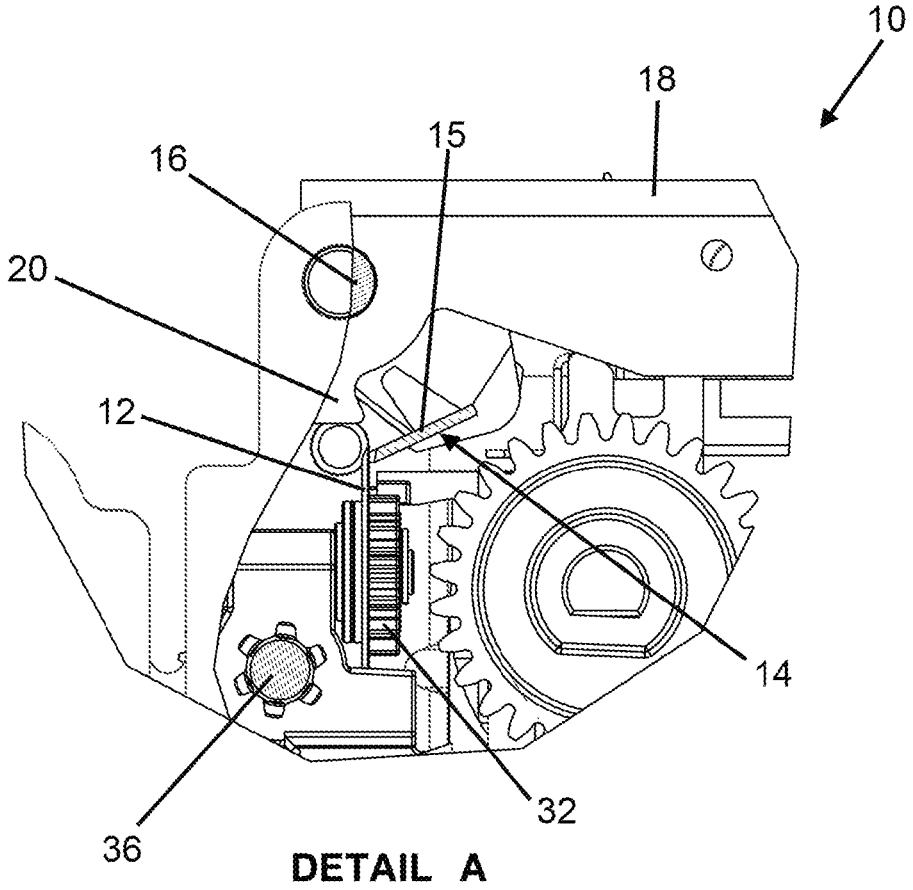
FIG. 2B shows Detail A of FIG. 2A.
Figure 3A:
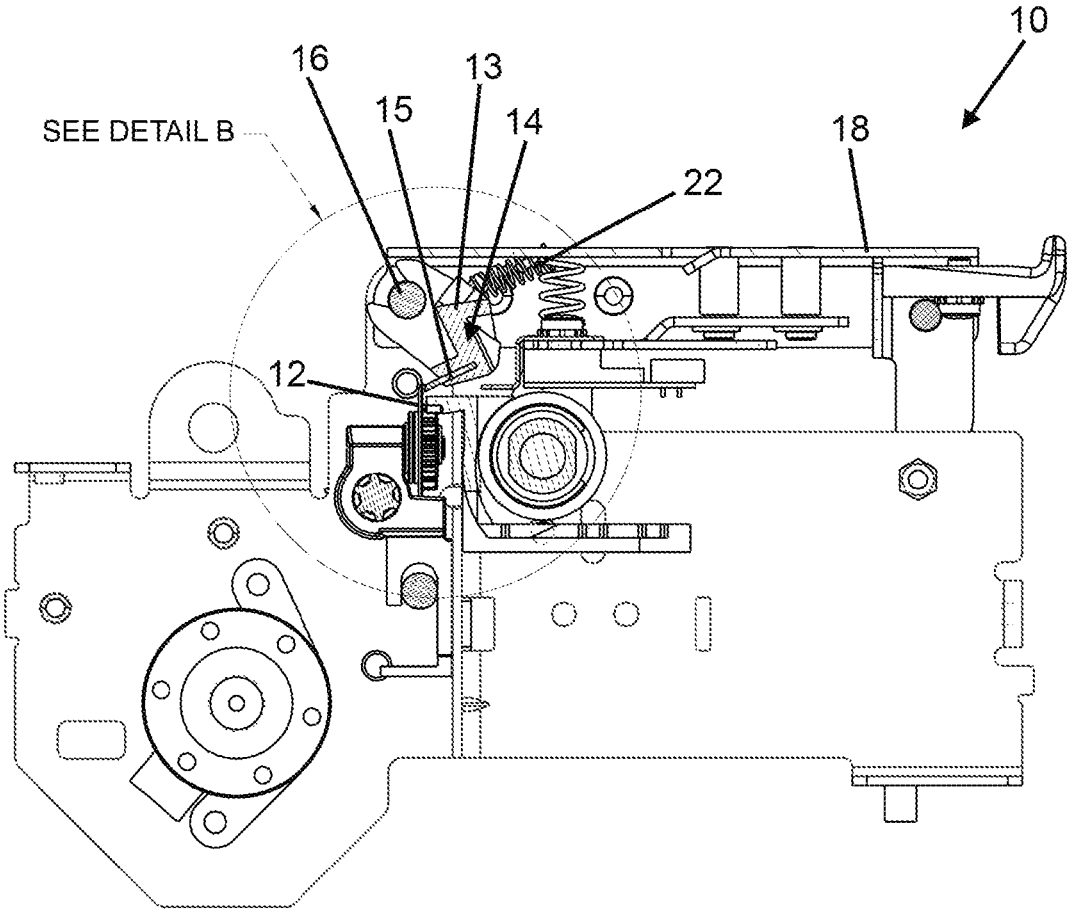
FIG. 3A shows a further section view of an example embodiment of a printer mechanism with the cover closed in accordance with the present invention.
Figure 3B:
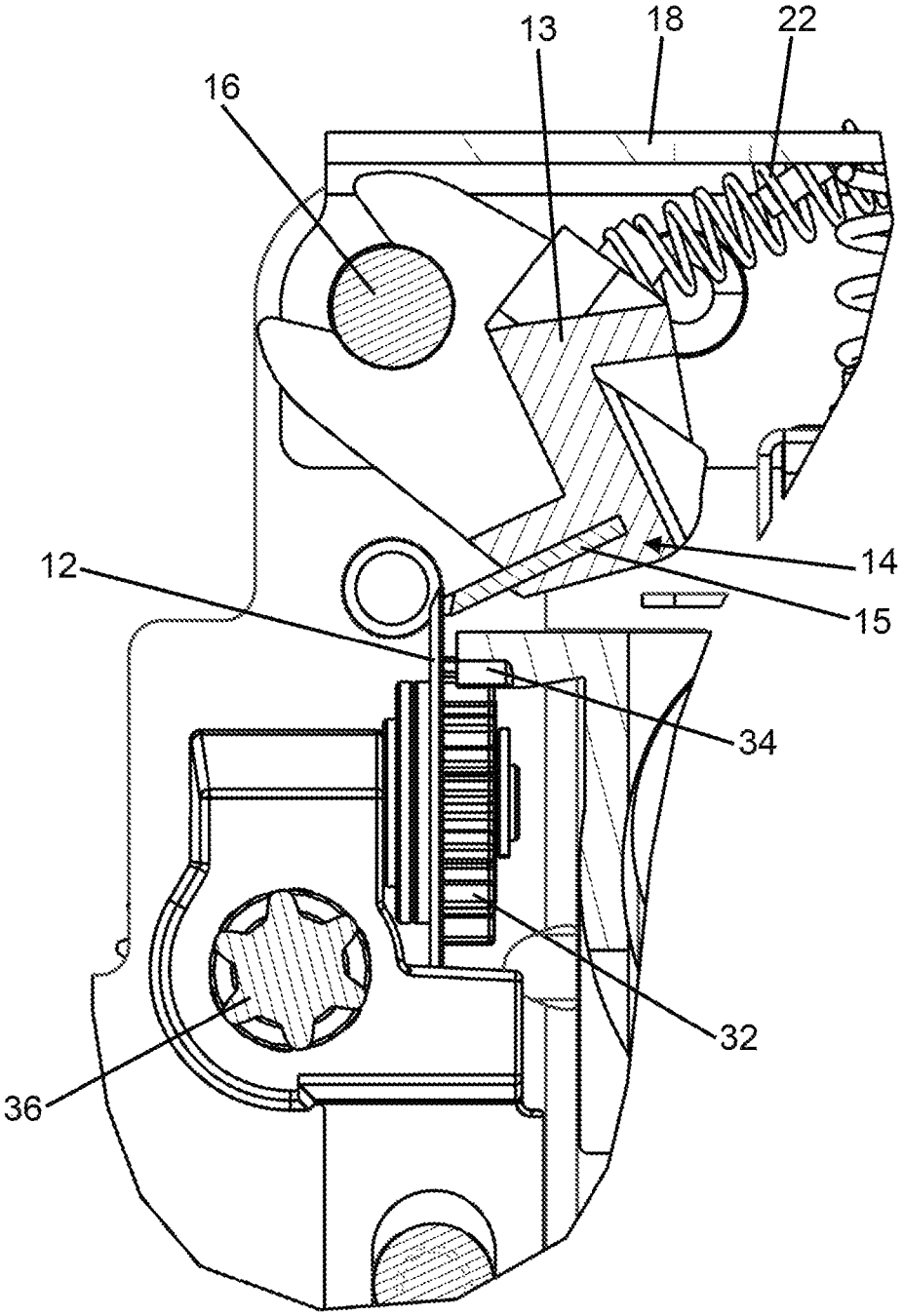
FIG. 3B shows Detail B of FIG. 3A.
Figure 4A:
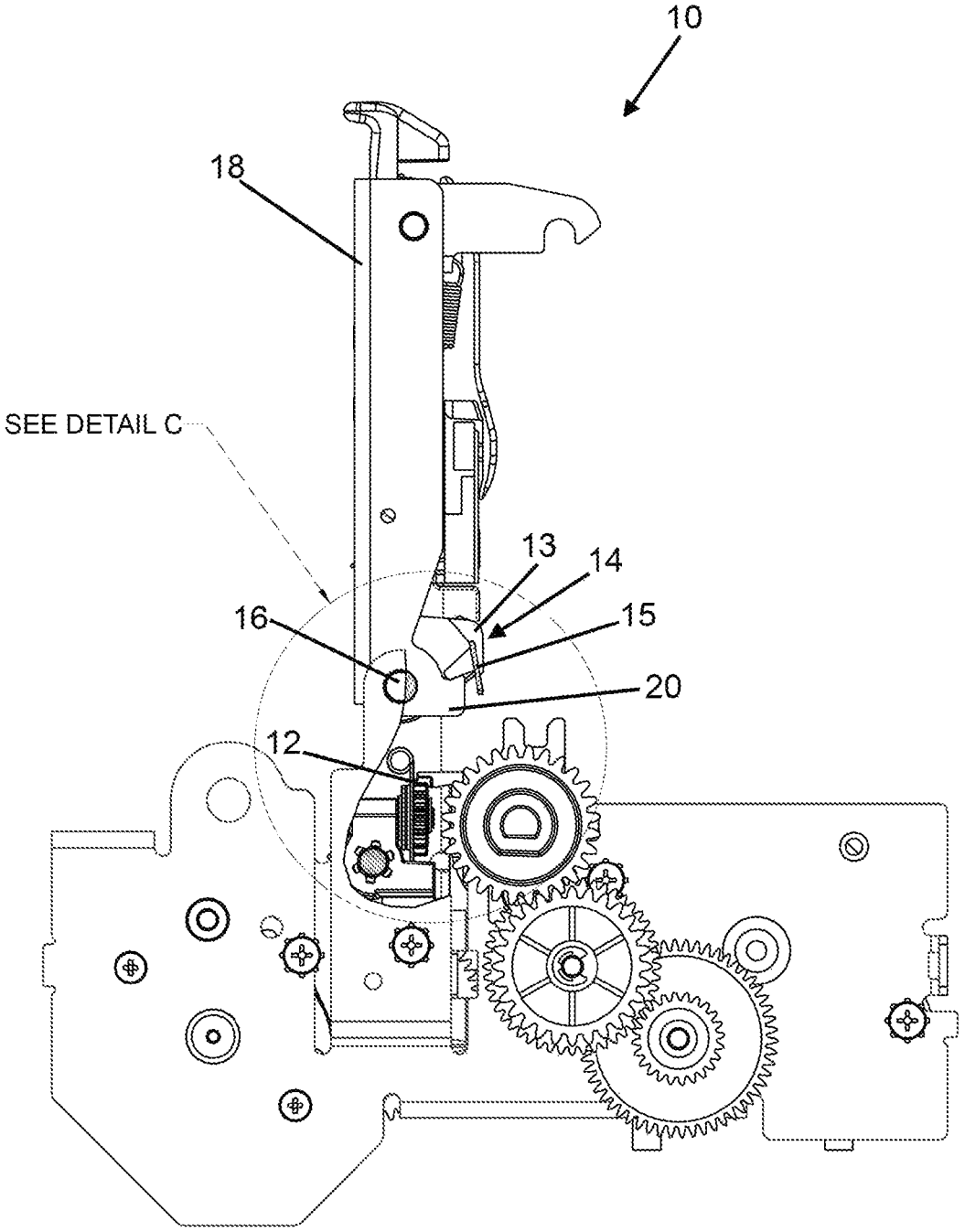
FIG. 4A shows a section view of an example embodiment of a printer mechanism with the cover open in accordance with the present invention.
Figure 4B:
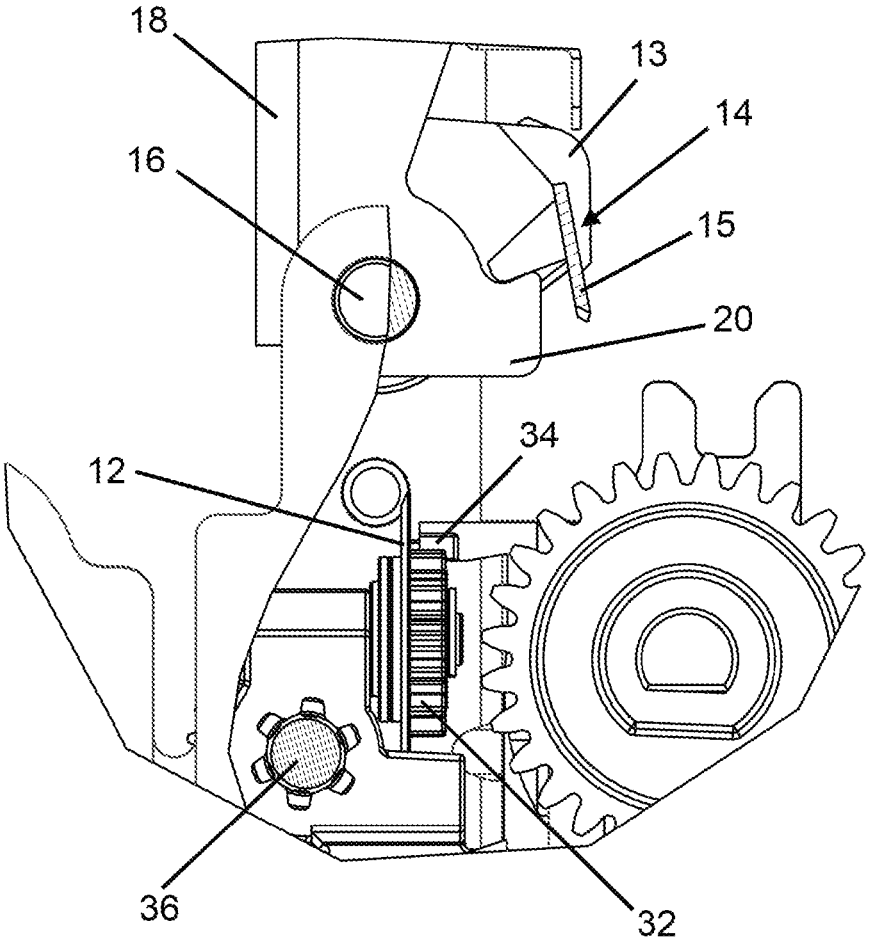
FIG. 4B shows Detail C of FIG. 4A.
Figure 5A:
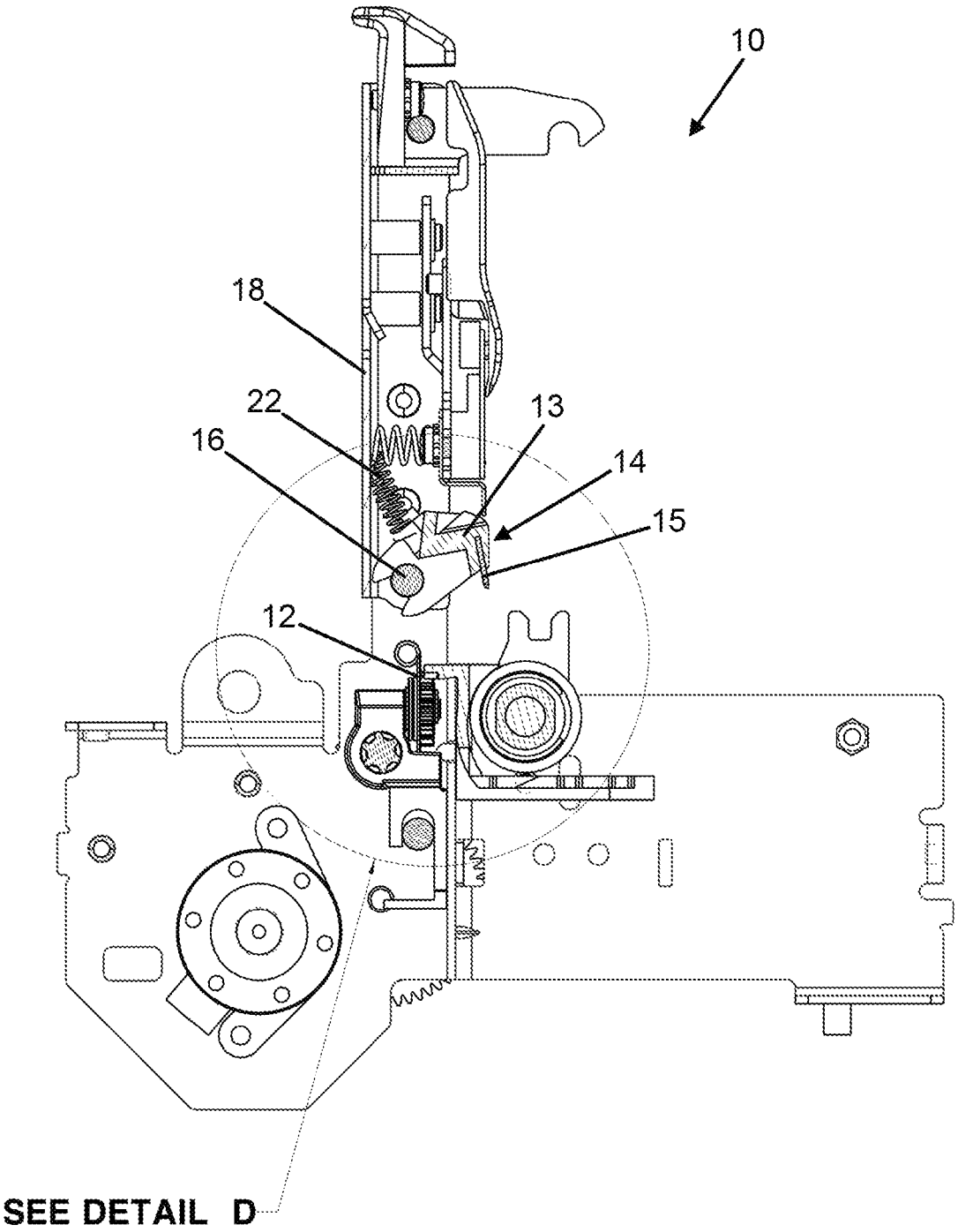
FIG. 5A shows a further section view of an example embodiment of a printer mechanism with the cover open in accordance with the present invention.
Figure 5B:
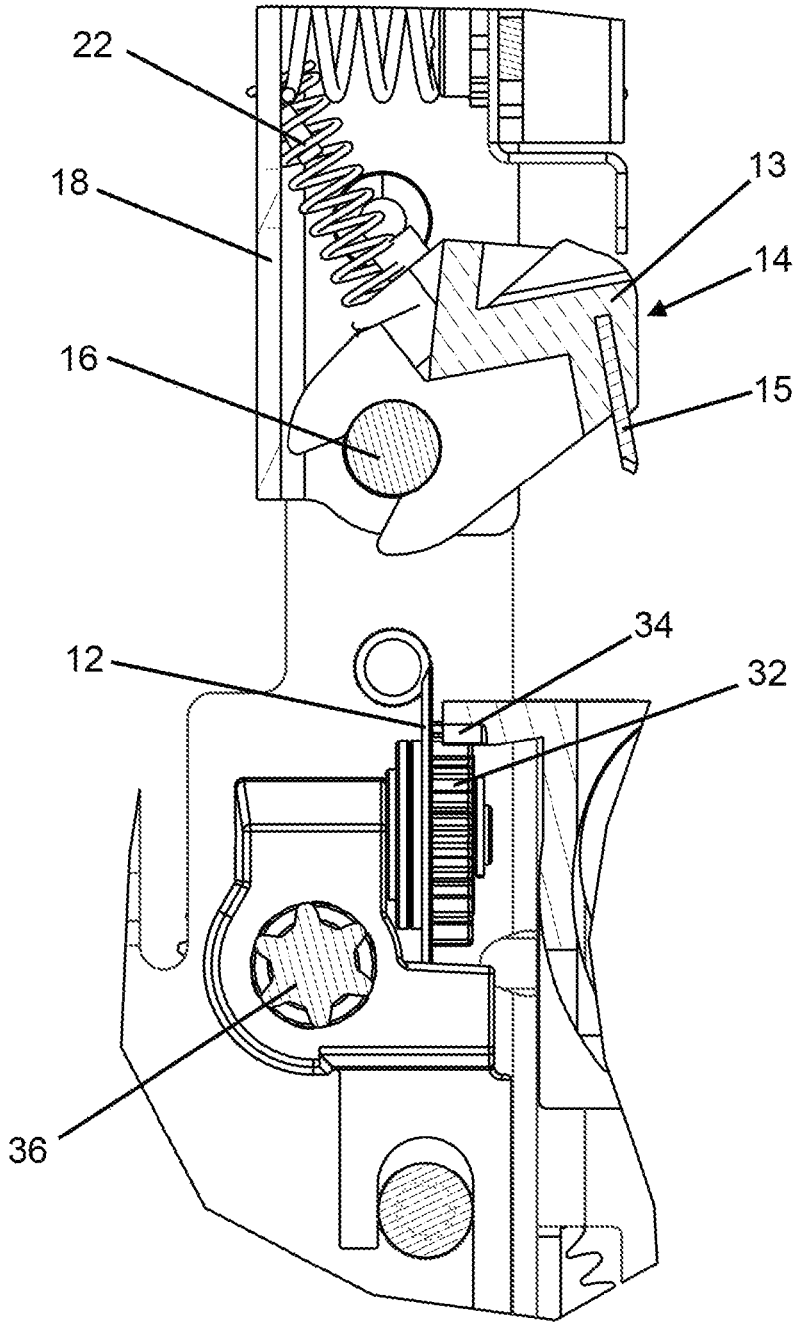
FIG. 5B shows Detail D of FIG. 5A.
Figure 6:
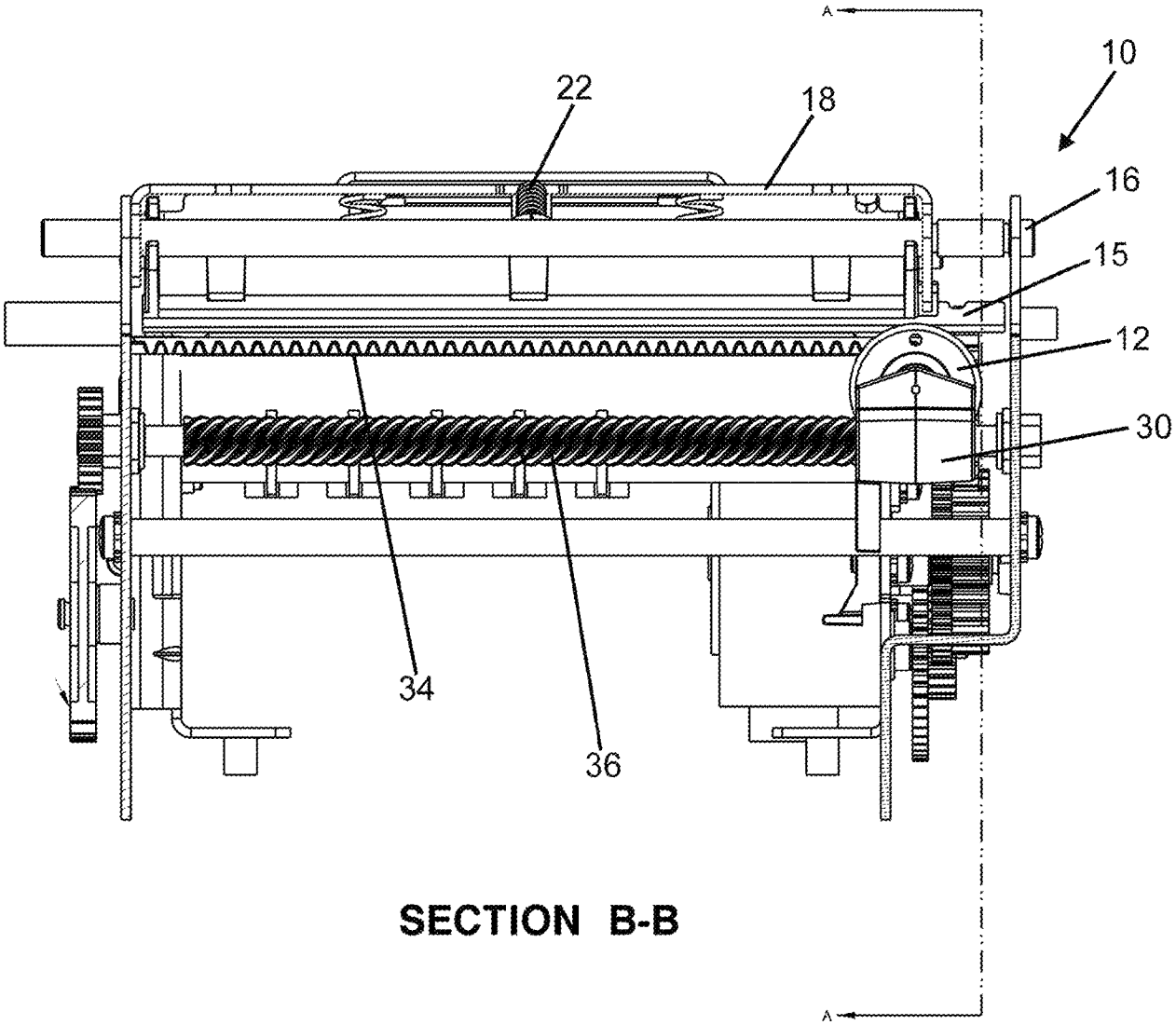
FIG. 6 shows a front view of an example embodiment of a printer mechanism with the cover closed in accordance with the present invention.
Figure 7:
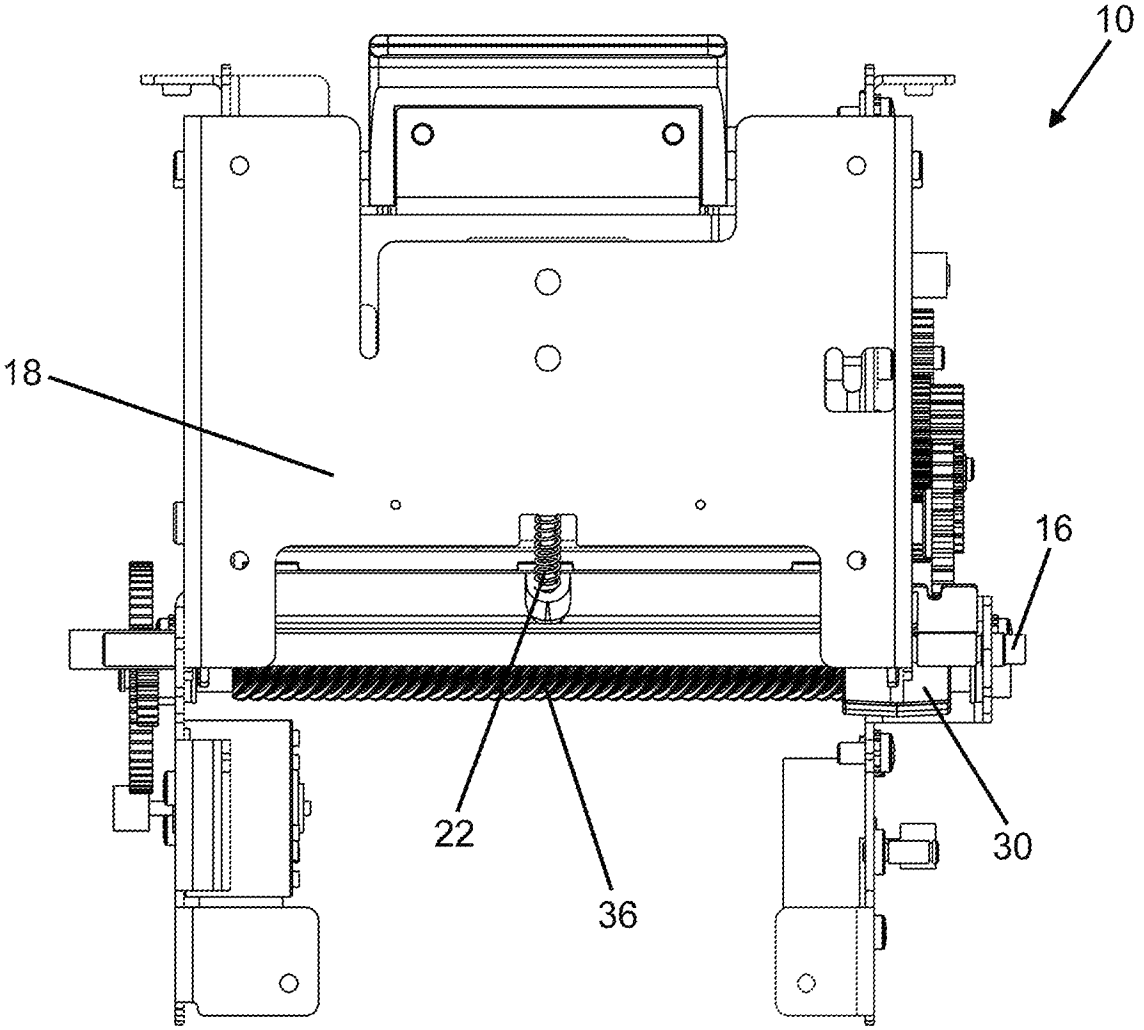
FIG. 7 shows a top view of an example embodiment of a printer mechanism with the cover closed in accordance with the present invention.

An example embodiment of a cutter mechanism 10 for a printer in accordance with the present invention is shown in FIGS. 1-7. The cutter mechanism 10 comprises a rotary cutter 12 and a straight blade assembly 14. The rotary cutter 12 may be mounted for rotation about a rotation axis and for translation across at least a portion of a width of a paper path perpendicular to the rotation axis. The straight blade assembly 14 may be mounted for rotation about a shaft 16 and adapted to cooperate with the rotary cutter 12. The straight blade assembly 14 may comprise a straight blade 15 extending across the width of the paper path. A printer mechanism cover 18 is mounted coaxially on the shaft 16 together with the straight blade assembly 14 so as to be movable between a closed position (as shown for example in FIG. 1) and an open position (as shown for example in FIG. 4A). A portion 20 of the cover 18 may impact the straight blade assembly 14 when the cover 18 is moved from the closed position to the open position, causing the straight blade 15 to be moved away from the rotary cutter 12.

The paper path runs between the rotary cutter 12 and the straight blade 15 in the closed position of the printer mechanism cover 18. Paper media traveling along the paper path between the rotary cutter 12 and the straight blade 15 may be cut when the rotary cutter 12 is translated across the paper path.

The straight blade assembly 14 may further comprise a mount 13 for securing the straight blade 15 to the shaft 16 for rotation. The shaft 16 may extend through the mount 13. The mount 13 may comprise a plastic mount. The straight blade assembly may be created by an insert molding process, where the straight blade 15 is inserted into a plastic mold used to create the plastic mount 13.

The portion 20 of the cover 18 interacts with the mount 13 to move the straight blade 15 away from the rotary cutter 12 when the cover 18 is moved from the closed to the open position.

The straight blade 15 may contact the rotary cutter 12 in the closed position of the cover 18. The straight blade assembly 14 may be moved away from the cover 18 in the closed position of the cover 18. The straight blade assembly 14 may rest on the cover 18 in the open position of the cover 18.

The cutter mechanism 10 may further comprise a biasing mechanism for biasing the straight blade 15 against the rotary cutter 12 in the closed position of the cover 18. The biasing mechanism may comprise at least one spring 22 extending between the cover 18 and the straight blade assembly 14. The spring 22 may comprise a compressed spring which presses the straight blade 15 against the rotary cutter 12.

The cutter mechanism 10 may further comprise a carriage 30 for carrying the rotary cutter 12, and a gear 32, rack 34, and lead screw 36 assembly for rotating and translating the rotary cutter 12. The rotary cutter 12 may be rotatably mounted on the carriage 30. The gear 32 may be mounted to the rotary cutter 12. The carriage 30 may be mounted on the lead screw 36 and adapted to translate along the lead screw 36 upon rotation of the lead screw 36. As the carriage 30 translates along the lead screw 36, teeth of the gear 32 contact corresponding teeth of the rack 34, causing the rotary cutter 12 to rotate as the carriage 30 translates.

The present invention also includes methods corresponding to the above-described apparatus. An example embodiment of a method for cutting paper media in a printer in accordance with the present invention may comprise: providing a rotary cutter 12 mounted for rotation about a rotation axis and for translation across at least a portion of a width of a paper path perpendicular to the rotation axis; mounting a straight blade assembly 14 for rotation about a shaft 16 and for cooperation with the rotary cutter 12, the straight blade assembly 14 comprising a straight blade 15 extending across the width of the paper path; and mounting a printer mechanism cover 18 coaxially on the shaft 16 so as to be movable between a closed position and an open position. In a closed position of the cover 18 in which the rotary cutter 12 is in engagement with the straight blade 15, the rotary cutter 12 may be translated across at least a portion of the width of the paper path for cutting the paper media during a cutting action. A portion of the cover 18 may impact the straight blade assembly 14 when the cover 18 is moved from the closed position to the open position, causing the straight blade 15 to be moved away from the rotary cutter 12.

The method embodiments of the present invention may also include various features of the apparatus embodiments discussed above.

By mounting the straight blade assembly 14 for rotation with the printer mechanism cover 18, the rotary blade 12 and corresponding gear mechanisms remain in the printer mechanism frame, and do not move when the cover is opened. This reduces the overall size and complexity of the cutter mechanism 10 compared to prior art mechanisms where the rotary blade is movable with the cover. Further, enabling the straight blade assembly 14 to be separated from the rotary cutter 12 simply by opening the printer mechanism cover 18 provides improved serviceability and reliability, and enables easy loading of paper and clearance of paper jams.

It should now be appreciated that the present invention provides improved cutter mechanism for a printer and corresponding methods.

Although the invention has been described in connection with various illustrated embodiments, numerous modifications and adaptations may be made thereto without departing from the spirit and scope of the invention as set forth in the claims.

What is claimed is:

1. A cutter mechanism for a printer, comprising:

a rotary cutter mounted for rotation about a rotation axis and for translation across at least a portion of a width of a paper path perpendicular to the rotation axis; and a straight blade assembly mounted for rotation about a shaft and adapted to cooperate with the rotary cutter, the straight blade assembly comprising a straight blade extending across the width of the paper path;

wherein:

a printer mechanism cover is mounted coaxially on the shaft so as to be movable between a closed position and an open position;

a portion of the cover impacts the straight blade assembly when the cover is moved from the closed position to the open position, causing the straight blade to be rotated on the shaft and moved away from the rotary cutter; and the straight blade assembly is mounted for rotation on the shaft independently of the cover.

2. The cutter mechanism in accordance with claim 1, wherein the straight blade assembly further comprises a mount for securing the straight blade to the shaft for rotation.

3. The cutter mechanism in accordance with claim 1, wherein the straight blade contacts the rotary cutter in the closed position of the cover.

4. The cutter mechanism in accordance with claim 1, wherein the straight blade assembly is moved away from the cover in the closed position of the cover.

5. The cutter mechanism in accordance with claim 1, further comprising:

a biasing mechanism for biasing the straight blade against the rotary cutter in the closed position of the cover.

6. The cutter mechanism in accordance with claim 5, wherein the biasing mechanism comprises at least one spring extending between the cover and the straight blade assembly.

7. The cutter mechanism in accordance with claim 1, further comprising:

a carriage for carrying the rotary cutter;

a gear, rack, and lead screw assembly for rotating and translating the rotary cutter;

wherein:

the rotary cutter is rotatably mounted on the carriage;

the gear is mounted to the rotary cutter;

the carriage is mounted on the lead screw and adapted to translate along the lead screw upon rotation of the lead screw; and as the carriage translates along the lead screw, teeth of the gear contact corresponding teeth of the rack, causing the rotary cutter to rotate as the carriage translates.

8. A method for cutting paper media in a printer, comprising:

providing a rotary cutter mounted for rotation about a rotation axis and for translation across at least a portion of a width of a paper path perpendicular to the rotation axis;

mounting a straight blade assembly for rotation about a shaft and for cooperation with the rotary cutter, the straight blade assembly comprising a straight blade extending across the width of the paper path;

mounting a printer mechanism cover coaxially on the shaft so as to be movable between a closed position and an open position;

in a closed position of the cover in which the rotary cutter is in engagement with the straight blade, translating the rotary cutter across at least a portion of the width of the paper path for cutting the paper media during a cutting action;

wherein:

a portion of the cover impacts the straight blade assembly when the cover is moved from the closed position to the open position, causing the straight blade to be rotated on the shaft and moved away from the rotary cutter; and the straight blade assembly is mounted for rotation on the shaft independently of the cover.

9. The method in accordance with claim 8, wherein the straight blade assembly further comprises a mount for securing the straight blade to the shaft for rotation.

10. The method in accordance with claim 8, wherein the straight blade contacts the rotary cutter in the closed position of the cover.

11. The method in accordance with claim 8, wherein the straight blade assembly is moved away from the cover in the closed position of the cover.

12. The method in accordance with claim 8, further comprising:

biasing the straight blade against the rotary cutter in the closed position of the cover.

13. The method in accordance with claim 12, wherein the straight blade is biased against the rotary cutter by a biasing mechanism which comprises at least one spring extending between the cover and the straight blade assembly.

14. The method in accordance with claim 8, further comprising:

providing a carriage for carrying the rotary cutter;

providing a gear, rack, and lead screw assembly for rotating and translating the rotary cutter;

wherein:

the rotary cutter is rotatably mounted on the carriage;

the gear is mounted to the rotary cutter;

the carriage is mounted on the lead screw and adapted to translate along the lead screw upon rotation of the lead screw; and as the carriage translates along the lead screw, teeth of the gear contact corresponding teeth of the rack, causing the rotary cutter to rotate as the carriage translates.

* * * * *